United States Patent [19]

Theilen

[11] 4,423,973

[45] Jan. 3, 1984

[54] RIBBON ELEVATING MECHANISM FOR RIBBON CASSETTES

[75] Inventor: Rolf Theilen, Furth, Fed. Rep. of Germany

[73] Assignee: Triumph-Adler A.G. fur Buro- und Informationstechnik, Nuremberg, Fed. Rep. of Germany

[21] Appl. No.: 327,944

[22] Filed: Dec. 7, 1981

[30] Foreign Application Priority Data

Jan. 17, 1981 [DE] Fed. Rep. of Germany ... 8101069[U]

[51] Int. Cl.[3] ..... B41J 33/14

[52] U.S. Cl. ..... 400/208; 400/212; 400/215; 400/229; 400/248

[58] Field of Search ..... 400/194, 195, 196, 196.1, 400/207, 208, 208.1, 212, 215, 216, 229, 248, 234

[56] References Cited

U.S. PATENT DOCUMENTS

| | | | |
|---|---|---|---|
| 3,272,305 | 9/1966 | Page | 400/216 |
| 3,490,671 | 1/1970 | Hladky | 400/196 X |
| 3,882,989 | 5/1975 | Morelli | 400/208 |
| 3,899,065 | 8/1975 | Brignole | 400/208 |
| 3,900,099 | 8/1975 | Hengelhaupt | 400/215 |
| 3,904,016 | 9/1975 | Hengelhaupt | 400/208 |
| 3,918,569 | 11/1975 | Parker | 400/229 X |
| 4,003,460 | 1/1977 | Gray et al. | 400/212 |
| 4,020,940 | 5/1977 | Daley et al. | 400/208 |
| 4,084,683 | 4/1978 | Moss | 400/248 X |

FOREIGN PATENT DOCUMENTS

| | | | |
|---|---|---|---|
| 1047430 | 1/1979 | Canada | 400/208 |
| 2743256 | 4/1979 | Fed. Rep. of Germany | 400/212 |
| 56-67288 | 6/1981 | Japan | 400/208 |

OTHER PUBLICATIONS

Xerox Disclosure Journal, "Uniform Ribbon Tension for Impact Printer Ribbon", Kockler et al., vol. 4, No. 2, Mar./Apr. 1979, pp. 181–182.

*Primary Examiner*—Ernest T. Wright,Jr.
*Attorney, Agent, or Firm*—Joseph R. Spalla

[57] ABSTRACT

The invention relates to a mechanism for raising and lowering a ribbon in front of the typing area of a typewriter or similar machine. The mechanism is so designed that only a few lightweight plastic parts need be moved thereby greatly reducing the actuating force necessary to elevate a ribbon. The mechanism also is configured to track the ribbon such that deformation of the ribbon as could impair proper functioning of the lifting and/or transporting of the ribbon during the ribbon lifting motion is minimized.

1 Claim, 2 Drawing Figures

RIBBON ELEVATING MECHANISM FOR RIBBON CASSETTES

Figure 1:
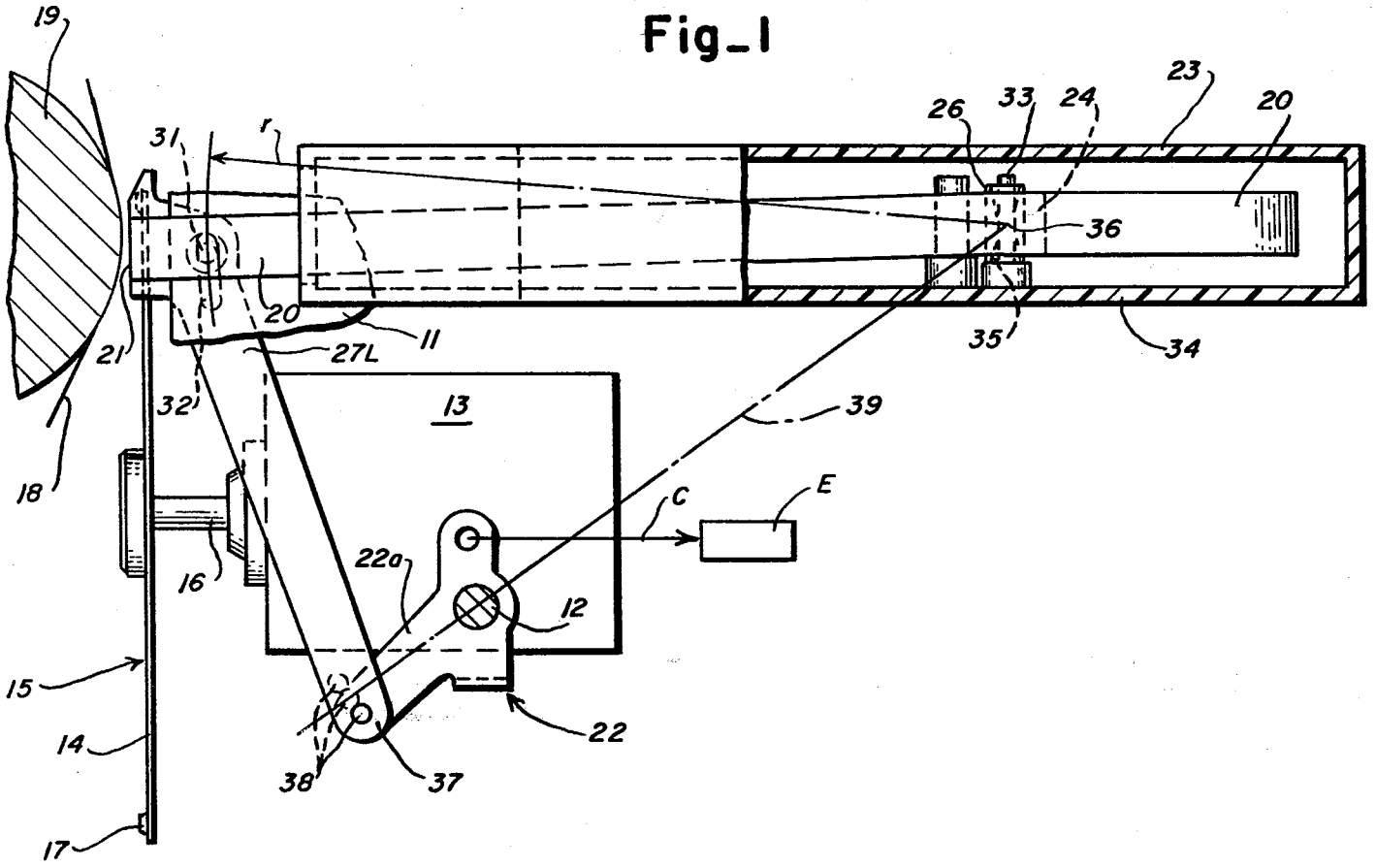

The invention relates to ribbon elevating mechanism for typewriters or similar office machines having a type carrier carriage supporting a type carrier, a motor for positioning the type carrier, and a ribbon cartridge housing the ribbon.

When raising or lowering a ribbon which occurs in timed relation to the transport of the ribbon in lengthwise direction, the ribbon must be so guided as to preclude deformation. In carbon ribbons in particular, it is essential that the ribbon edges not fold over or that the coated side be damaged inasmuch as faults in characters typed and malfunctions in the ribbon transport can be the consequence.

As disclosed in U.S. Pat. No. 3,272,305 to P. F. Page, drives for elevating ribbon guides in a linear lifting motion are known. In these drives however edge tensions develop in the ribbon. As disclosed in U.S. Pat. No. 3,900,099 to H. Hengelhaupt, ribbon tension or deformation may be avoided in the provision of vibrator arms having a long radius from pivots lateral of the cassette and adjacent deflector rolls for reorienting the direction of the ribbon. This solution is often impracticable due to space considerations, especially when large cassettes are involved. Too, long vibrator arms add to inertia and have a tendency to overtravel.

Accordingly, it is an object of the invention to provide a low-inertia ribbon raising and lowering device which assures an optimal ribbon lifting motion while yet employing a minimum of components.

Figure 2:
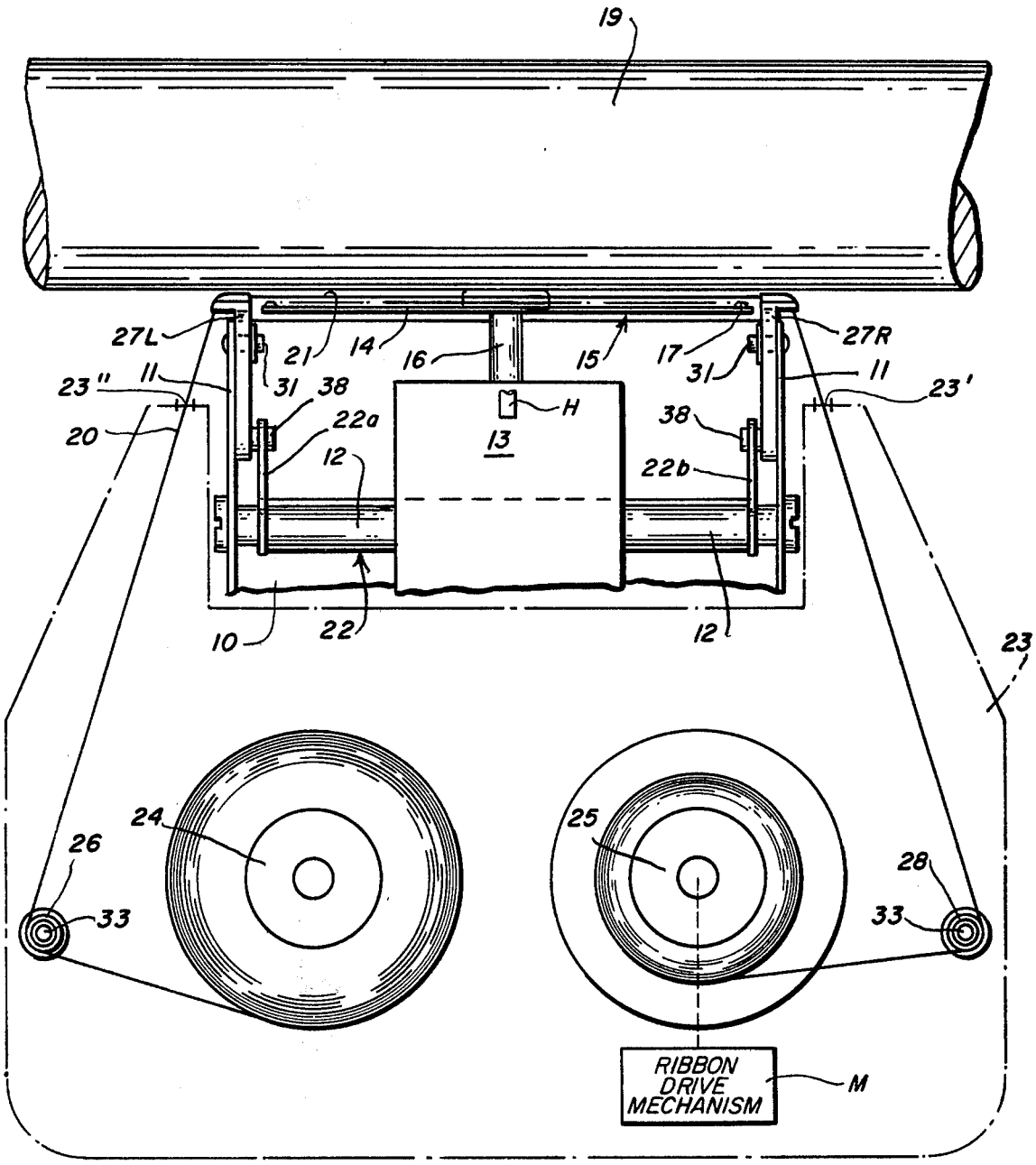

Other objects, features and advantages of the present invention will become known to those skilled in the art from a reading of the following detailed description when taken in conjunction with the accompanying drawing wherein like reference numerals designate like or corresponding parts throughout the several views thereof, and wherein:

FIG. 1 is a side elevational view of the device according to the invention with cassette side walls cut away; and FIG. 2 is a top view of the device of FIG. 1 in smaller scale.

Referring now to the drawing there is shown in the figures thereof parts of a typewriter having a movable carriage 10 supporting a type disc print element. As shown in FIG. 2 the carriage 10 has spaced carriage side parts 11 which support aligned shafts 12 which pivotally support between them a motor 13. The motor 13 is adapted upon suitable energization to position a selected one of a plurality of spokes 14 of a type wheel or disc 15, which is removably secured to the motor shaft 16, for printing by a hammer H, only partially shown. The resilient circumferentially arranged spokes 14 of the type disc 15 carry at their ends types 17 which are adapted, when the hammer H drives the selected spoke 14, to print on a record 18 (FIG. 1) supported by a stationary platen 19 through a ribbon 20, a length 21 of which is positioned between the type disc 15 and the record 18 parallel to and elevatable opposite a printing line. As will be appreciated the motor 13 is pivotally mounted to facilitate type disc changes.

As shown in FIGS. 1 and 2 and with particular reference to FIG. 1, a ribbon lift yoke generally designated by reference numeral 22 having spaced arms **22*a* and 22*b* is pivotally mounted on the aligned shafts 12. Ribbon 20 is contained in a cassette 23 wherein it is wound on a rotatably supported ribbon supply spool 24, and is wound on a rotatably mounted ribbon take up spool 25, with the take up spool 25 drivingly connected to ribbon drive mechansim M on the carriage 10 when the cassette 23 is mounted on the carriage 10. As shown wound ribbon 20 is drawn off the supply spool 24, around a turn around ribbon deflector ribbon 26, forwardly through an exit opening 23'' from the cassette 23, around the upper end of a left ribbon guide 27L, across the printing line, around the upper end of a right ribbon guide 27R, rearwardly to a cassette entry opening 23', back into the cassette 23, around a turn around ribbon deflector roller 28 and to the driven take up spool 25** for winding.

As shown the left and right ribbon guides 27L and 27R are spaced apart a distance slightly more than the diameter of the type disc 15. Adjacent their upper ends each ribbon guide 27L and 27R is guided by a pin 31 extending laterally from the adjacent carriage side parts 11 into an arcuate slot 32 in the ribbon guides 27L, 27R.

As particularly shown in FIG. 2 the deflector rollers 26 and 28 are mounted for rotation about pins 33 extending vertically from the bottom wall 34 of the cassette 23. Also as shown in FIG. 1 the bores 35 of the deflector rolls 26 and 28 narrow down from each end toward the center thereby to permit the deflector rollers 26 and 28 to pivot about a horizontal pivot axis 36 as the ribbon guides 27L, 27R are elevated. This expedient coupled with the long radius from pivot axis 36 to the upper ends of the ribbon guides 27L and 27R serves to minimize edge tensions;

With particular reference to FIG. 1 the ribbon guides 27L, 27R extend downwardly and their lower ends 37 are connected as at points 38 to the ends of associated arms **22*a* and 22*b* of the ribbon lift yoke 22. The ribbon lift yoke 22 is operated in a clockwise direction by a force acting in the direction of arrow C and generated for example by an electromagnet E. As viewed in FIG. 1 when the ribbon guides 27L, 27R are elevated midway of an elevating movement, the points of connection 38 to the lift arms 22*a*, 22*b* thereto, the pivot center of the ribbon lift yoke 22, and the pivot axis 36 of the rollers 26, 28 will all lie on a straight line 39**.

The ribbon cassette 23 is securely mounted on the cartridge side parts 11 so that it performs no pivoting motion during a lifting motion of the ribbon 21. However, the deflector rollers 26 and 28 which are mounted on pins 33 and which are so shaped internally as to enable them to tilt about a horizontal pivot axis 36 over a certain limited range function to alleviate ribbon deformation during lifting motion of the ribbon guides 27L, 27R and of the ribbon 20. It is evident from FIG. 1 in particular that the deformation of the ribbon 21 is the less, the greater the radius r relative to the arcuate elongated guide slots 32 of the ribbon guides 27L, 27R.

The components of the device according to the invention are preferably made of plastic. This satisfies the requirement for a stable low-inertia drive system requiring low actuating force. In addition, the low mass of the ribbon elevating mechanism helps keep the total weight supported by the movable carriage low.

The invention claimed is:

1. Ribbon elevating mechanism for a single element typewriter having a carriage movable from print point to print point along a print line, a ribbon cassette containing ribbon mounted on said carriage forwardly of said print line, a positioning motor support on said carriage below and rearwardly of said ribbon cassette, a positioning motor pivotally mounted on said positioning motor support, and a print element mounted to be driven to selected orientations by said positioning motor, said mechanism including a pair of spaced generally vertically oriented ribbon guides supporting at the upper ends thereof a length of ribbon therebetween parallel to said print line for elevation to said print line, vertical slots adjacent the upper ends of said ribbon guides and guide pins on said carriage extending into said slots for guiding said ribbon guides during elevation, the lower ends of said ribbon guides extending below and rearwardly of said positioning motor support, a pair of ribbon lift arms pivotally mounted on said positioning motor support for powered pivoting movement and connected to the lower ends of said ribbon guides for elevating said ribbon guides, said carriage supported cassette having ribbon exit and entry openings substantially opposite the upper ends of said ribbon guides, said carriage supported cassette containing a rotatably mounted ribbon supply spool from which said ribbon is drawn off through said exit opening and a rotatably mounted take-up spool for taking up said ribbon through said entry opening, vertical pins in said cassette located laterally outwardly of said supply and take-up spools, ribbon deflection rollers rotatably mounted on said vertical pins for tracking said ribbon between said ribbon guides and said supply and take-up spools, said deflection rollers being formed to pivot about an axis perpendicular to the rotational axis thereof as said ribbon is being elevated by said ribbon guides, and said pivot axis of said deflection rollers being substantially equidistant from said guide pins on said carriage and said points of connection between said lift arms and said ribbon guides.

* * * * *